United States Patent [19]

Cobb

[11] Patent Number: 4,779,677

[45] Date of Patent: Oct. 25, 1988

[54] OIL WELL FLUID PROCESSING SYSTEM

[75] Inventor: James R. Cobb, Oklahoma City, Okla.

[73] Assignee: Incorporated Tank Systems, Inc., Oklahoma City, Okla.

[21] Appl. No.: 52,007

[22] Filed: May 19, 1987

[51] Int. Cl.[4] ..... E21B 15/00; E21B 43/34

[52] U.S. Cl. ..... 166/79; 137/172; 166/267

[58] Field of Search ..... 166/79, 265–267; 208/370; 196/155; 220/5 A, 5 R; 280/5 R, 460 R; 137/172, 376, 899

[56] References Cited

U.S. PATENT DOCUMENTS

| | | | |
|---|---|---|---|
| 1,758,453 | 5/1930 | Mays | 166/79 |
| 1,857,788 | 5/1932 | Murphy | 166/79 X |
| 2,363,657 | 11/1944 | Dennis | 280/5 R X |
| 2,457,959 | 1/1949 | Walker | 166/266 X |
| 2,490,305 | 12/1949 | Jones | 280/5 R |
| 3,186,734 | 6/1965 | Touhey | 280/460 R |
| 3,953,298 | 4/1976 | Hogan | 208/370 X |
| 4,359,089 | 11/1982 | Strate et al. | 166/79 |
| 4,597,437 | 7/1986 | McNabb | 166/79 |

FOREIGN PATENT DOCUMENTS

| | | | |
|---|---|---|---|
| 166225 | 10/1982 | Japan | 280/5 R |
| 1188231 | 4/1970 | United Kingdom | 280/5 R |

*Primary Examiner*—George A. Suchfield

*Attorney, Agent, or Firm*—Dunlap, Codding & Peterson

[57] ABSTRACT

An oil well fluid processing system having a heater-treater and a gas separator mounted on a skid constructed in three sections that can be pinned together for transport. The heater-treater is pivotally mounted on the central section of the skid for pivotation to a position overlaying an end section that carries hydraulic actuating cylinders to raise the heater-treater to a vertical position. The gas separator is mounted on the other end section, and the gas separator and heater-treater are pre-plumbed with fluidly connectable pipe manifolds. The pipe manifold for the heater-treater has two portions that mate when the heater-treater is raised to a vertical position. Pinning of the skid sections is effected via apertured plates extending from the ends of the skid sections.

15 Claims, 7 Drawing Sheets

OIL WELL FLUID PROCESSING SYSTEM

CROSS-REFERENCE TO RELATED APPLICATION

The subject matter of the present application is related to my co-pending U.S. patent application Ser. No. 052,605 entitled MOBILE STORAGE TANK BATTERY, filed on May 19, 1987.

BACKGROUND OF THE INVENTION

The present invention relates generally to improvements in oil field equipment and more particularly, but not by way of limitation, to apparatus emplaced near oil wells for processing fluids produced by the wells.

The fluids produced by an oil well generally consist of a mixture of natural gas, petroleum and salt water which must be separated into separate components for disposition. For this purpose, it is standard practice to emplace a fluid processing system at the site of the well to initially separate off the gaseous component for transmittal to a pipeline and, subsequently, to separate the liquid component into petroleum and water for storage in a tank battery emplaced at the well site. The oil can then be sold directly from tanks of the battery and the salt water can be temporarily stored for later removal and final disposition in a manner that will not cause harm to the environment.

The emplacement of a fluid processing system at a well has, in the past, entailed considerable expense. Elements of the processing system are large and must be transported to the site of the well over highways that are often crossed by overpasses having limited clearance. Because of this, it has been standard practice to transport the elements of the fluid processing system separately for assembly at the well site.

This mode of establishing a fluid processing system at a well is both expensive and time consuming. Once the components of the system have reached the well site, they must be unloaded from transporting vehicles, positioned, and connected together and to the well. The connection of the components of prior art systems includes the incorporation in connecting pipes of fluid control devices so that a large number of pipes must be cut, threaded and connected to place the system in a condition in which it can be used to separate well fluids. Because of this need to plumb and connect components of conventional fluid processing systems in the field, it has not been uncommon in the past for the assembly of the system to take several days using a work force that may number four or five people. Thus, labor costs associated with preparing a well for production after the well has been drilled have not been inconsequential.

Moreover, it has often occurred in the past that the expense of preparing a well for production is not only wasted but is incurred twice without being offset by production of oil from the well. At the time a well is completed, it is not known whether the well will produce gas and oil in quantities that will justify the expense of maintaining the well in production. If not, the well is shut down and the system for processing the fluids must be disassembled, again taking several days using a work force of four or five people, for removal from the well site. While the major components of the fluid processing system can be salvaged, all of the labor that has gone into the assembly of the processing system at the well will have been lost and additional losses are incurred in disassembling the system and preparing the components of the system for transport from the site.

SUMMARY OF THE INVENTION

The present invention reduces the cost of bringing an oil well into production by providing a fluid processing system that is readily transported to and from an oil well and can be rapidly assemled and disassembled at the site of the well using a minimum number of workers. Specifically, in one aspect, the invention permits large elements of the fluid processing system to be rapidly changed from an easily transported package to a pre-plumbed unit which need only be connected to other pre-plumbed elements to place the system in operation. To this end, the present invention contemplates that any large element of the fluid processing system, for example, a heater-treater used to separate oil and water, will be pivotally mounted on a skid so that the element can be moved to a horizontal position for transport and to a vertical position for use by means of actuating cylinders mounted on the skid. Moreover, the element is pre-plumbed by a pipe manifold having a portion on the skid and a portion mounted on the element itself with such portions positioned to permit rapid connection once the element has been raised to the position in which it will be used. Thus, establishment of the system at the site of the well is a matter of raising the fluid processing element so mounted on the skid, connecting the two portions of the pipe manifold, and further making connections to portions of the pipe manifold that are mounted on the skid. This can be accomplished in a matter of hours by a small work force. Moreover, should the well prove unprofitable, the fluid processing system can be rapidly dismantled by breaking the connections between the parts of the manifold and connections made to other elements of the fluid processing system and returning any fluid processing element pivotally mounted on a skid to a horizontal position for transport away from the well site.

In another aspect of the invention, the skid upon which components of the fluid processing system are mounted is constructed in parts that can be pinned together end-to-end to facilitate transport while permitting ready separation of the elements of the fluid processing system to meet the demands of the site and safety regulations. In this aspect of the invention, it is contemplated that portions of the system that do not enter into actual production of the well can be removed from the well site after the system has been readied for use. In particular, all elements of the system that are used solely to facilitate transport and readying other elements for use are mounted on separate skids for removal once the well has been placed in production. Since the elements can be used to ready other wells for production, production costs are minimized by limiting the need to provide a complete set of separate components of the fluid processing system for each well. Moreover, the possibility of theft is avoided by the removal of elements of the system that facilitate readying the system for transport and subsequent transport of the system.

An object of the present invention is to provide an oil well fluid processing system that can be rapidly emplaced at an oil well and rapidly removed therefrom with a small work force.

Another object of the invention is to provide a readily transportable fluid processing system for emplacement at the site of an oil well.

Yet another object of the invention is to provide an oil well fluid processing system which can be assembled into a package including handling equipment for placing the system into use and readily disassembled after the system has been placed into condition for use for removal and reuse of portions of the system whose functions are not associated with the separation of the oil well fluids into separate components.

Other objects, advantages and features of the present invention will become clear from the following detailed description of the invention when read in conjunction with the drawings and the appended claims.

BRIEF DESCRIPTION OF THE DRAWINGS

FIG. 6 is a cross section of the skid section shown in FIG. 4 taken along line 6—6 of FIG. 4.

FIG. 19 is a side elevational view of a portion of the system illustrating the manner in which one element of the fluid processing system is placed in a vertical position for use.

DESCRIPTION OF THE SYSTEM

Figure 1:
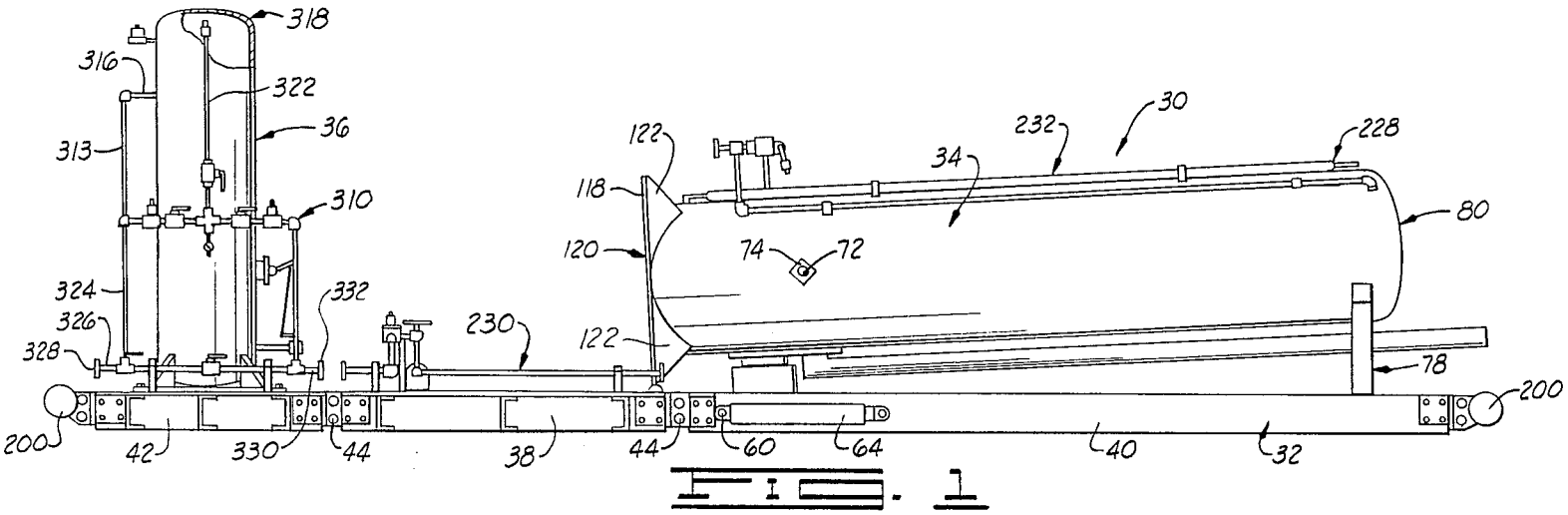
FIG. 1 is an elevational view of one side of the oil well fluid processing system of the present invention in a transport mode of the system.
Figure 2:
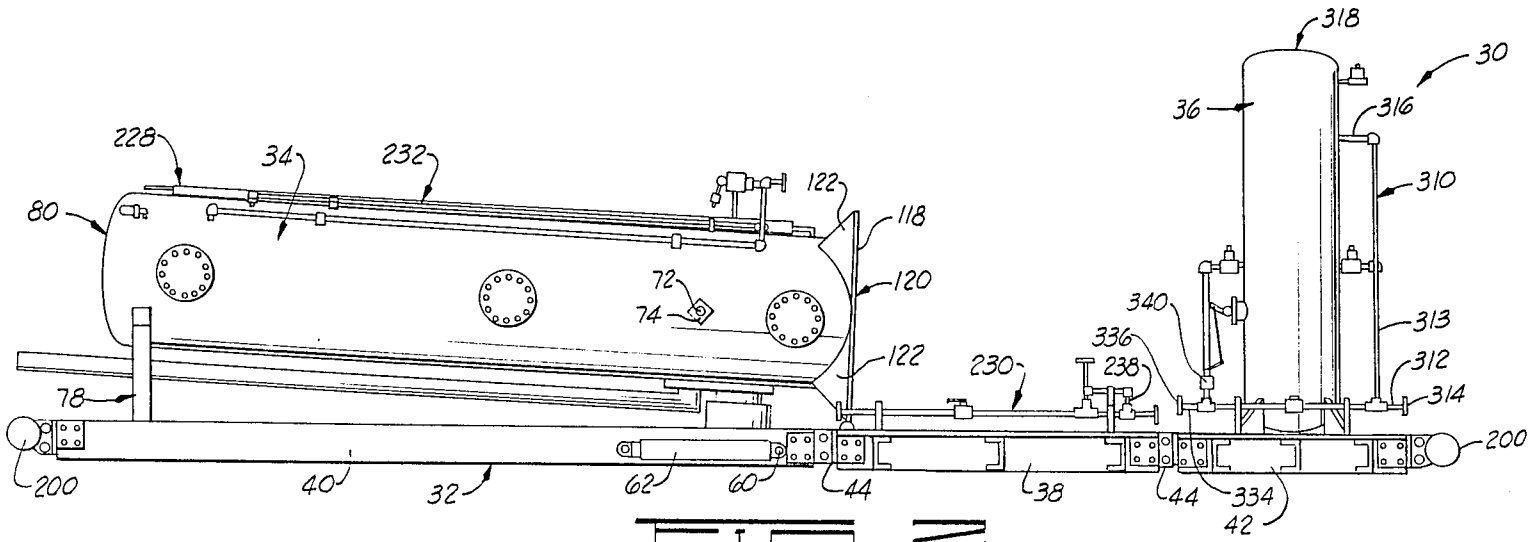
FIG. 2 is an elevational view of the other side of the system in the transport mode.
Figure 1:
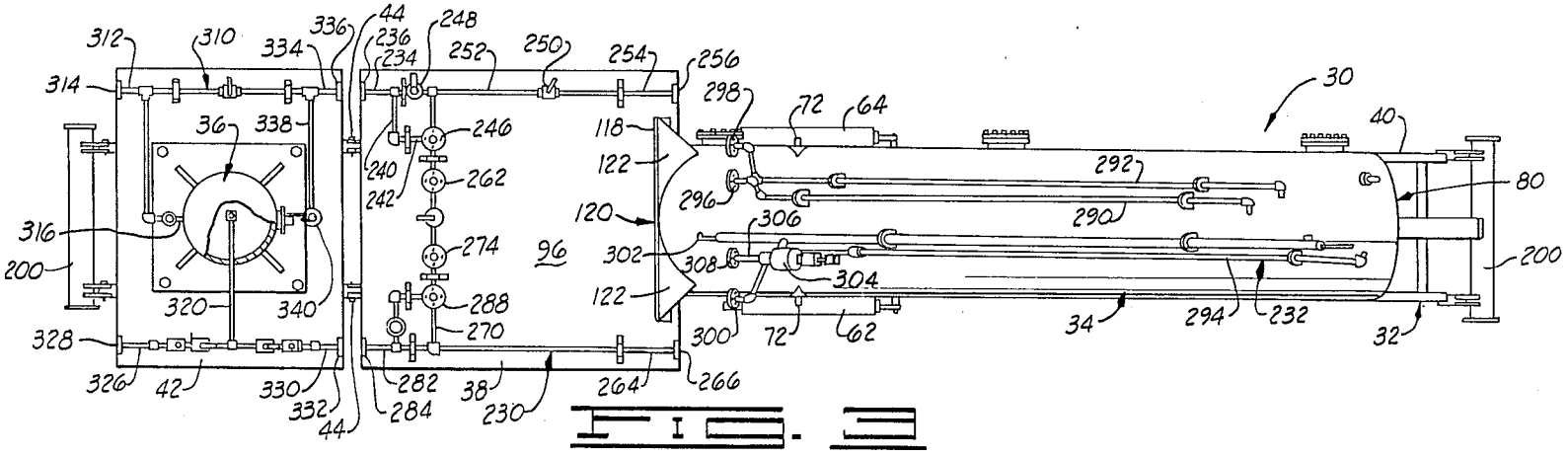
Figure 3:
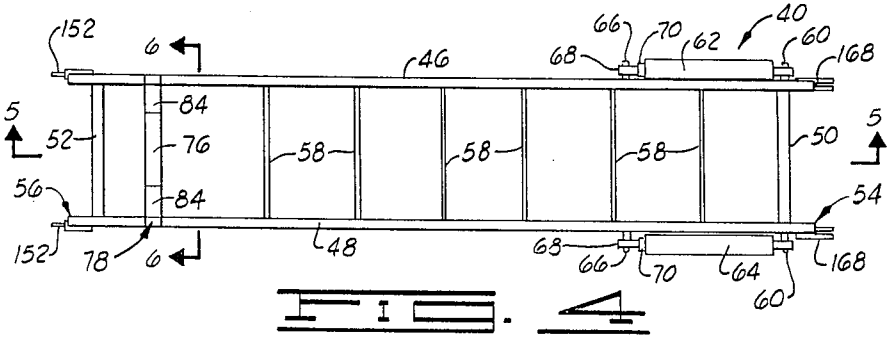
FIG. 3 is a top view of the system in the transport mode.

Referring now to the drawings in general and to FIGS. 1-3 in particular, shown therein and designated by the general reference numeral 30 is a portable oil well fluid processing system constructed in accordance with the present invention. As shown in these Figures, the oil well fluid processing system is generally comprised of a skid 32 upon which can be mounted selected fluid processing devices which, in the drawings, have been illustrated as a heater-treater 34, used for separating oil from salt water produced by a well, and a gas separator 36 utilized to separate natural gas from the oil and salt water produced by a well.

As illustrated in the drawings, the skid 32 is constructed in three parts to include a first section 38, a second section 40 and a third section 42 which are pinned together in a manner to be discussed below by a plurality of connector assemblies, generally designated by the reference numeral 44, to be discussed below.

Figure 4:
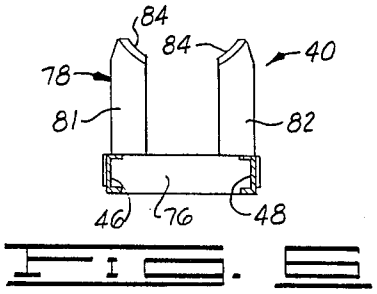
FIG. 4 is a top view of one of the sections of the skid of the system.
Figure 5:
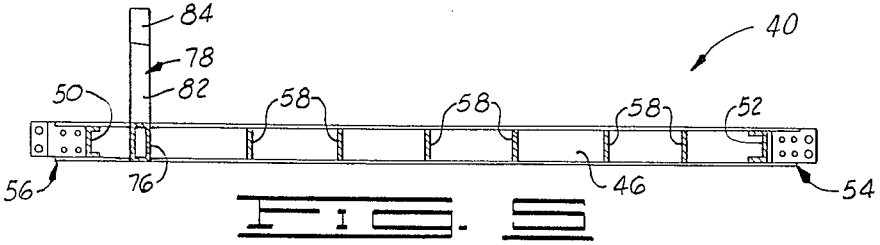
FIG. 5 is a cross section of the skid section of FIG. 4 taken along line 5—5 of FIG. 4.

Referring additionally to FIGS. 4-6, the second skid section 40 is comprised of two base beams 46 and 48 that are constructed of channel stock and held in a parallel relation by channel members 50 and 52 welded to the base beams 46 and 48 near the ends 54 and 56 of the second section 40 of the skid 32. A plurality of plates 58, longitudinally spaced along the second section 40 of the skid 32 are welded to the base beams 46 and 48 to extend laterally therebetween and form the skid section 40 into a rigid structure.

Adjacent the end 54 of the second skid section 40; that is, the end of the second skid section 40 that is connected to the first skid section 38 in a transport mode of the system 30 shown in FIGS. 1-3, circular pins 60 are welded to the outside surfaces of the base beams 46 and 48 to protrude laterally therefrom and provide an anchor for pivotal mounting of hydraulic actuating cylinders 62 and 64 on opposite sides of the second section 40 of the skid 32 as illustrated in FIGS. 1-4. Displaced a distance from the pins 60 toward the end 56 of the second skid section 40, additional pins 66 are welded to the base beams 46 and 48 to protrude laterally therefrom to support eyes 68 mounted on the ends of the pistons 70 of the hydraulic actuating cylinders 62 and 64 to secure the hydraulic actuating cylinders 62 and 64 to the skid 32 during transport of the oil well fluid processing system 30. It is contemplated that the hydraulic actuating cylinders 62 and 64 and the eyes 68 be loosely supported on the pins 60 and 68, and secured thereto by cotter keys (not shown in the drawings) so that the eyes 68 can be pulled from the ends of the pins 66 after removal of cotter keys through the pins 66 and manually moved in a vertical arc to be placed on pins 72 mounted on plates 74 welded to the sides of the heater-treater 34.

Adjacent the end 56 of the second skid section 40 remote from the hydraulic actuating cylinders, a rectangular tube 76 is welded to the base beams 46 and 48 to extend therebetween and both further strengthen the skid section 40 and proide a mount for a cradle 78 that supports portions of the heater-treater 34 adjacent an upper end 80 thereof during transport of the system 30 to the site of an oil well. The cradle 78 is conveniently constructed of two lengths of rectangular tubing 81 and 82 extending vertically from the base beams 46 and 48, welded thereto and to the tube 76, and having arcuate metal plates 84 welded to the upper ends thereof.

Figure 7:
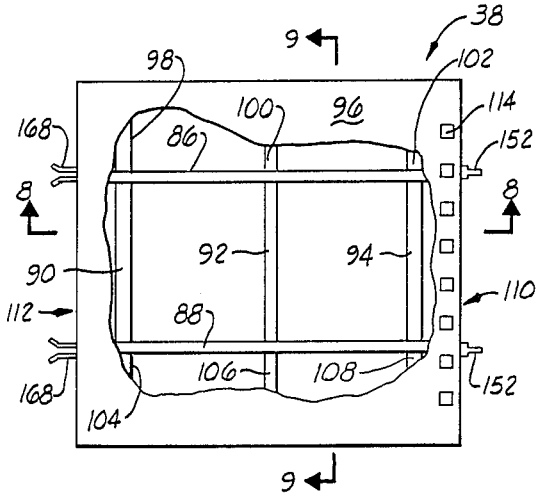
FIG. 7 is plan view in partial cutaway of another section of the skid of the system.
Figure 8:
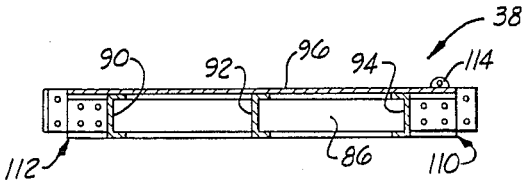
FIG. 8 is a cross section of the skid section shown in FIG. 7 taken along the line 8—8 of FIG. 7.
Figure 9:
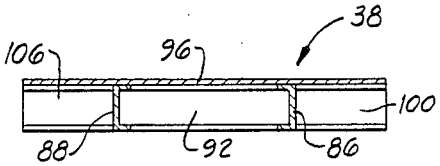
FIG. 9 is a cross section of the skid section shown in FIG. 7 taken along line 9—9 of FIG. 7.

Referring now to FIGS. 7-9, the first skid section 38 is similarly comprised of two longitudinally extending base beams 86 and 88, constructed of steel channel, that are spaced a distance equal to the spacing of the base beams 46 and 48 of the second skid section 40. Cross-beams 90-94, also constructed of channel stock, are welded to the base beams 86 and 88 and extend therebetween to form the first skid section 38 into a rigid structure. In order to provide for integral plumbing of the heater-treater 34 on the first skid section 38, the first skid section 38 is wider than the second skid section 40 and is provided with a cover plate 96 welded to the base beams 86 and 88 and to the beams 90–94. Laterally extensive portions of the cover plate 96 are supported by laterally extending channel beams 98–108 which are welded to the base beams 86 and 88 to extend laterally therefrom to underlay the laterally extensive portions of the cover plate 96 to which the beams 98–108 are welded.

Figure 20:
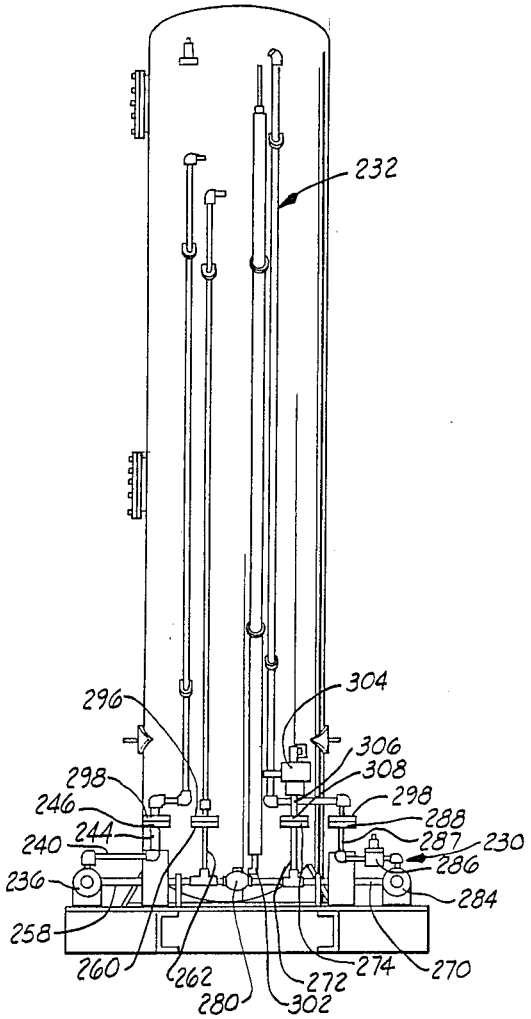
FIG. 20 is an end elevational view of the element of the system shown in FIG. 20 as positioned for use.
Figure 21:
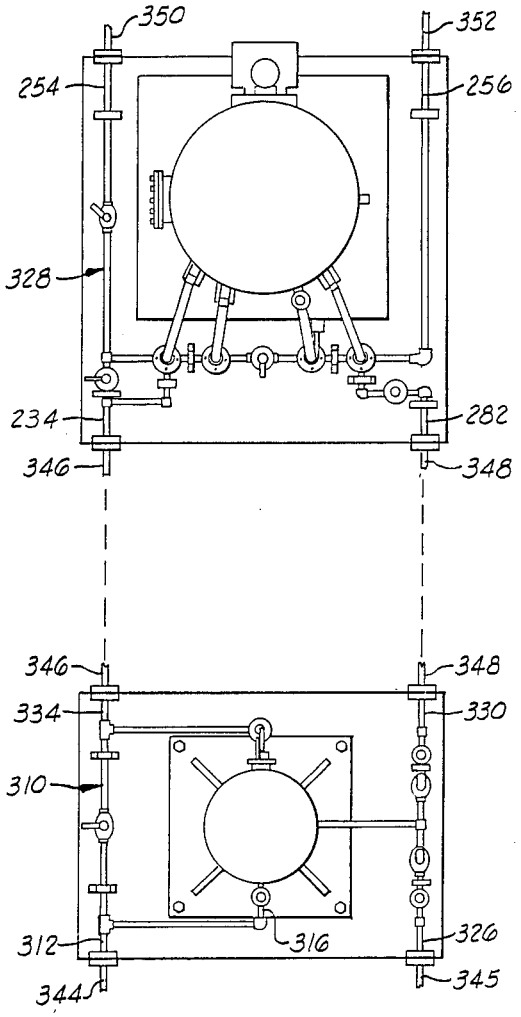
FIG. 21 is a plan view of the system as emplaced at the site of an oil well.

Near one end 110 of the first skid section 38 to which the end 54 of the second skid section 40 is connected during transport of the system 30, a row of hinge members 114 is welded to the top of the cover plate 96 to extend laterally in a series across central portions of the cover plate 96. Concentric holes (not numerically designated in the drawings) are formed through the members 114 so that the members 114 form a portion of a piano hinge used to pivotally connect the heater-treater 34 to the first skid section 38 for pivoting movement of the heater-treater 34 in the direction 116 on the first skid section 38 illustrated in FIG. 19. The piano hinge is completed by a similar row of hinge members (not numerically designated in the drawings) welded to a support plate 118 mounted on the lower end 120 of the heater-treater as shown in FIGS. 1–3 and a rod (not shown) that extends through the hinge members in a conventional manner. The heater-treater 34 is braced on the support plate 118 by brace plates 122 welded to the support plate 120 and the heater-treater 34 so that the heater-treater 34 can be moved as a unit between a lowered position shown in FIGS. 1–3 in which the heater-treater 34 overlays the second section 40 of the skid 32 and a raised position in which the heater-treater 34 extends vertically from the first section 38 of the skid 32 as shown in FIGS. 20 and 21.

Figure 10:
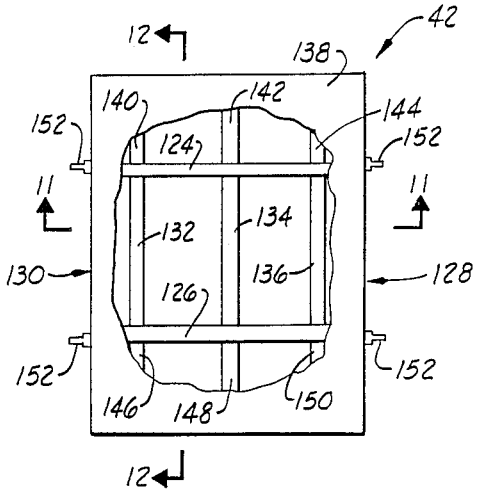
FIG. 10 is a plan view in partial cutaway of a third section of the skid of the system.
Figure 11:
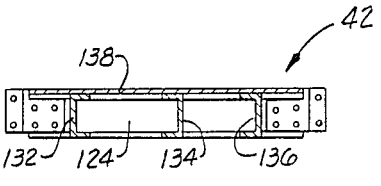
FIG. 11 is a cross section of the skid section shown in FIG. 10 taken along line 11—11 of FIG. 10.
Figure 12:
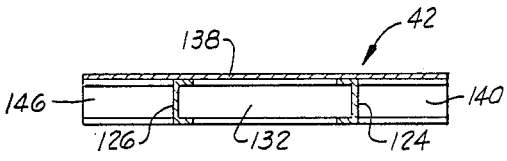
FIG. 12 is a cross section of the skid section shown in FIG. 10 taken along line 12—12 of FIG. 10.

The third skid section 42, particularly illustrated in FIGS. 10–12, is constructed similarly to the first skid section 38. Thus, the third skid section is comprised of two base beams 124 and 126 that are constructed of channel stock and extend longitudinally between ends 128 and 130 of the third skid section 42. The base beams 124 and 126 are spaced a distance equal to the spacing of the base beams 86 and 88 of the first skid section and the base beams 46 and 48 of the second skid section and maintained in such relation by channel members 132–136 welded between the base beams to extend laterally therebetween. As in the case of the first skid section 38, the second skid section 42 is provided with a cover plate 138 that is welded to the base beams 124 and 126 and the channel members 132–136 to extend laterally outwardly of both of the base beams 124 and 126. The laterally extending portions of the cover plate 138 are supported by channel members 140–150 welded to external sides of the base beams 124 and 126 to extend laterally therefrom below the cover plate 138 to which the channel members 140-150 are welded.

As has been noted above, one aspect of the present invention is the pinning of the skid sections together to permit selective placement of portions of the oil well fluid processing system 30 at the site of an oil well and, further, to permit the removal of portions of the system that are not directly involved in the fluid separation process from the well site both to permit reuse of such portions of the system 30 and as a theft prevention means. Specifically, it is contemplated that portions of the system 30 utilized only to facilitate transport of the system 30 will be removed from the site of the well to prevent the theft of such portions and interfere with the theft of portions of the system 30 that are left at the site of the well. This aspect of the invention is faciltated by the provision of the connector assemblies 44, the two connectors of which have been illustrated in FIGS. 13–16.

Figure 13:
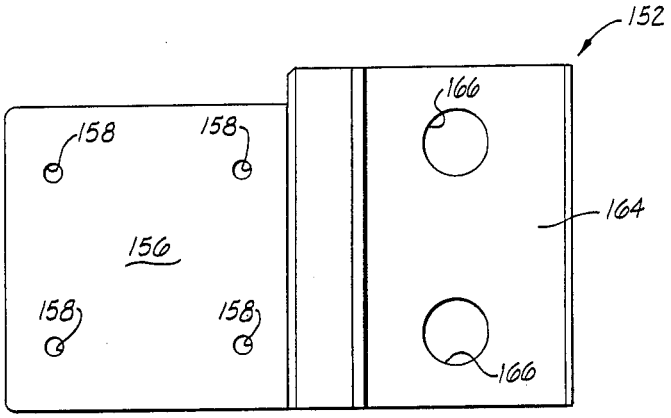
FIG. 13 is a side elevational view of a male connector used to connect the sections of the skid for transport.
Figure 14:
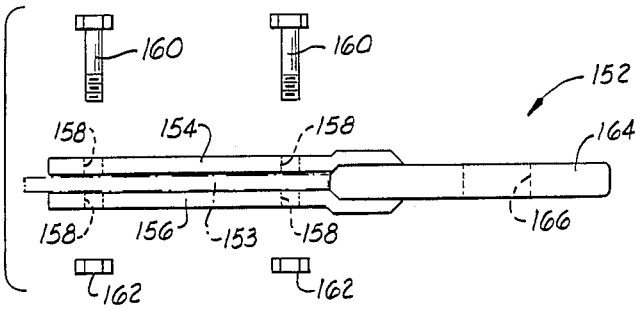
FIG. 14 is a plan view of the connector shown in FIG. 13.
Figure 15:
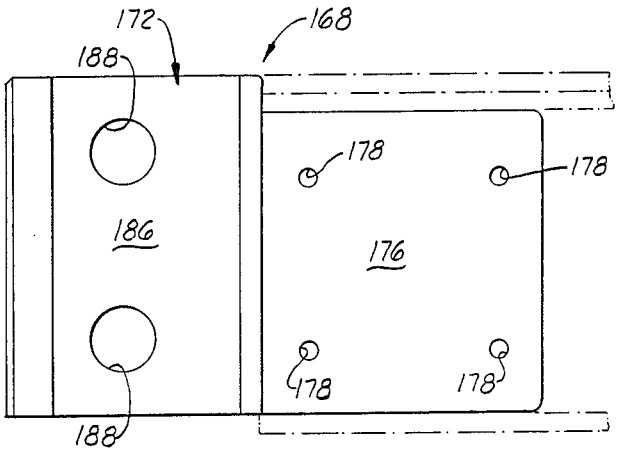
FIG. 15 is a side elevational view of a female connector used to connect the skid sections for transport.
Figure 16:
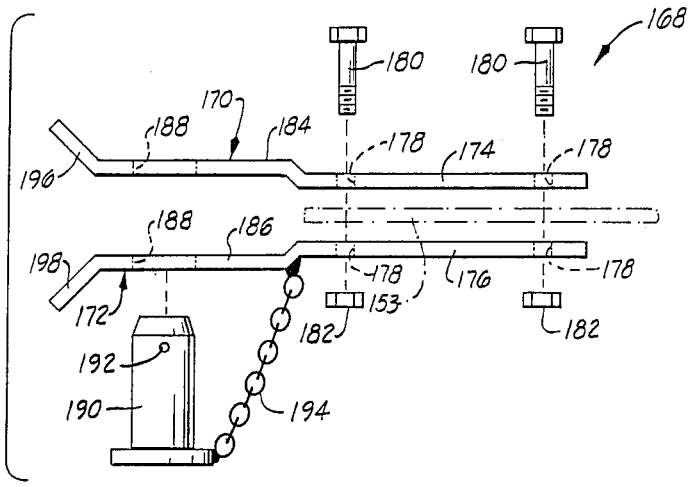
FIG. 16 is an exploded plan view of the female connector shown in FIG. 15.

Referring first to FIGS. 13 and 14, shown therein is a male connector 152 that is constructed in a manner to permit bolting of the connector 152 to the vertical web 153 of any of the base beams 46, 48, 86, 88, 124 and 126 of the skid sections 38, 40 and 42. To this end, each male connector is comprised of a pair of parallel plates 154 and 156 that are spaced apart a distance sufficient to receive the web 153 and each of the plates 154 and 156 is provided with an array of holes 158 to receive bolts 160 that extend through the plates 154 and 156 and through an identical array of holes (not shown in the drawings) formed through the vertical webs of each of the base beams of the skid sections adjacent the ends of the base beams. Thus, a male connector can be mounted on the end of any base beam by positioning the plates 154 and 156 about the vertical web 153 of the base beam, inserting the bolts 160 through the plates 154, 156 and the web 153 of the base beam and securing the bolts in position via nuts 162. At one end of each plate 154 and 156 that will extend from the end of a web 153 when the male connector 152 is mounted on a base beam, the separation of the plates 154 and 156 is increased to receive a plate 164, welded to the plates 154 and 156, that will extend from the end of the web 153 of a base beam in vertical alignment therewith. Vertically spaced holes 166 are formed through the plate 164 of the male connector to receive a pin (not shown in FIGS. 13 and 14) utilized to pin the male connector 152 to a female connector 168 illustrated in FIGS. 15 and 16.

Like the male connector 152, the female connector 168 is comprised of two plates, generally designated 170 and 172, having portions 174 and 176 that can be placed about the sides of the vertical web 153 of one of the base beams for bolting the plates 170 and 172 in a sandwiching relationship to the web 153 via an array of holes 178 identical to the array of holes formed through the vertical webs 153 of each of the base beams of the skid sections 38–42. The plates 170 and 172 are secured to the web 152 by sandwiching the web 153 between the portions 174 and 176, inserting bolts 180 through the portions 174 and 176 and through the web 153 and securing the assembly together with nuts 182 that fit on the ends of the bolts 180. At such times that the female connector 168 is bolted to the web 153, portions 184 and 186 of the plates 170 and 172 extend longitudinally from the web 153, to extend longitudinally of one of the skid sections 38–42, and the plates 170 and 172 are bent apart to space the portions 184 and 186 a distance sufficient to receive the plate 164 of a male connector 152. Vertically spaced holes 188 are formed through each of the portions 184 and 186 of each of the plates 170 and 172 respectively, to align with the holes 166 formed through the plates 164 of the male connectors 152. Thus, a male connector can be secured to a female connector by inserting the plate 164 between the plates 170 and 172, inserting pins 190 through the holes 166 and 180 and securing the pins 190 in the connectors 152 and 168 via cotter keys (not shown) inserted through holes 192 formed through the pins 190. As shown for the pin 190 illustrated in FIG. 16, the pins 190 may be kept with the female connectors by attaching the pins 190 to the plate 172 of the female connector 168 with a chain 194 having one end welded to a pin 190 and one end welded to the plate 172. To facilitate the insertion of the plate 164 of a male connector 152 between the plates 170 and 172 of the female connector 168, portions of the plates 170 and 172 remote from the web 153 can be bent laterally at an angle as indicated at 196 and 198, for the plates 170 and 172 respectively, in FIG. 16.

With the male and female connectors 152 and 168 so constructed, connecting the skid sections 38–42 is rapidly accomplished by bolting appropriate connectors to the base beams of the skid sections. Thus, for example, female connectors 168 bolted to the base beams 46 and 48 (FIG. 4) of the second skid section 40, at the end 54 thereof, and male connectors 152 bolted to the base beams 86 and 88 (FIG. 7) of the first skid section 38, at the end 110 thereof, permit rapid pinning of the first skid section 38 to the second skid section 40. Similarly, female connectors 168 bolted to the base beams 86 and 88 of the first skid section 38, at the end 112 thereof, and male connectors 152 bolted to the base beams 124 and 126 of the third skid section 42, at the end 128 thereof, permit rapid pinning of the third skid section 42 to the second skid section 38.

Figure 17:
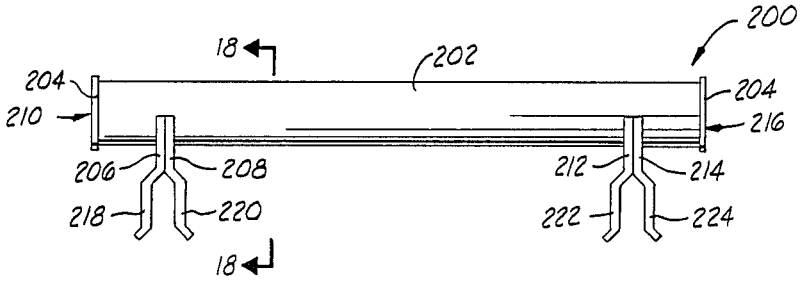
FIG. 17 is an elevational view of a detachable loading hitch connectable to the ends of the skid.
Figure 18:
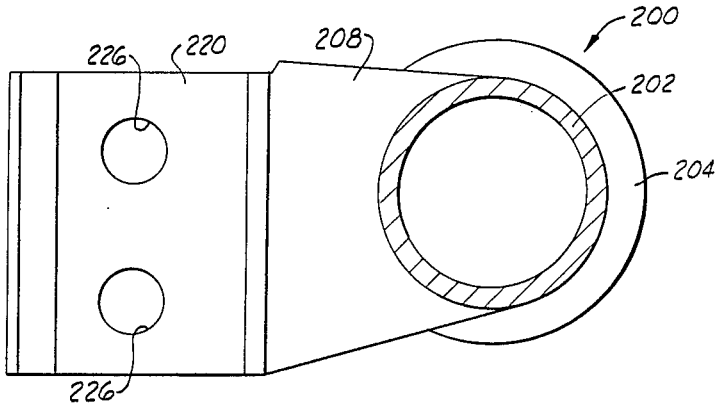
FIG. 18 is a cross section of the loading hitch taken along line 18—18 of FIG. 17.
Figure 15:
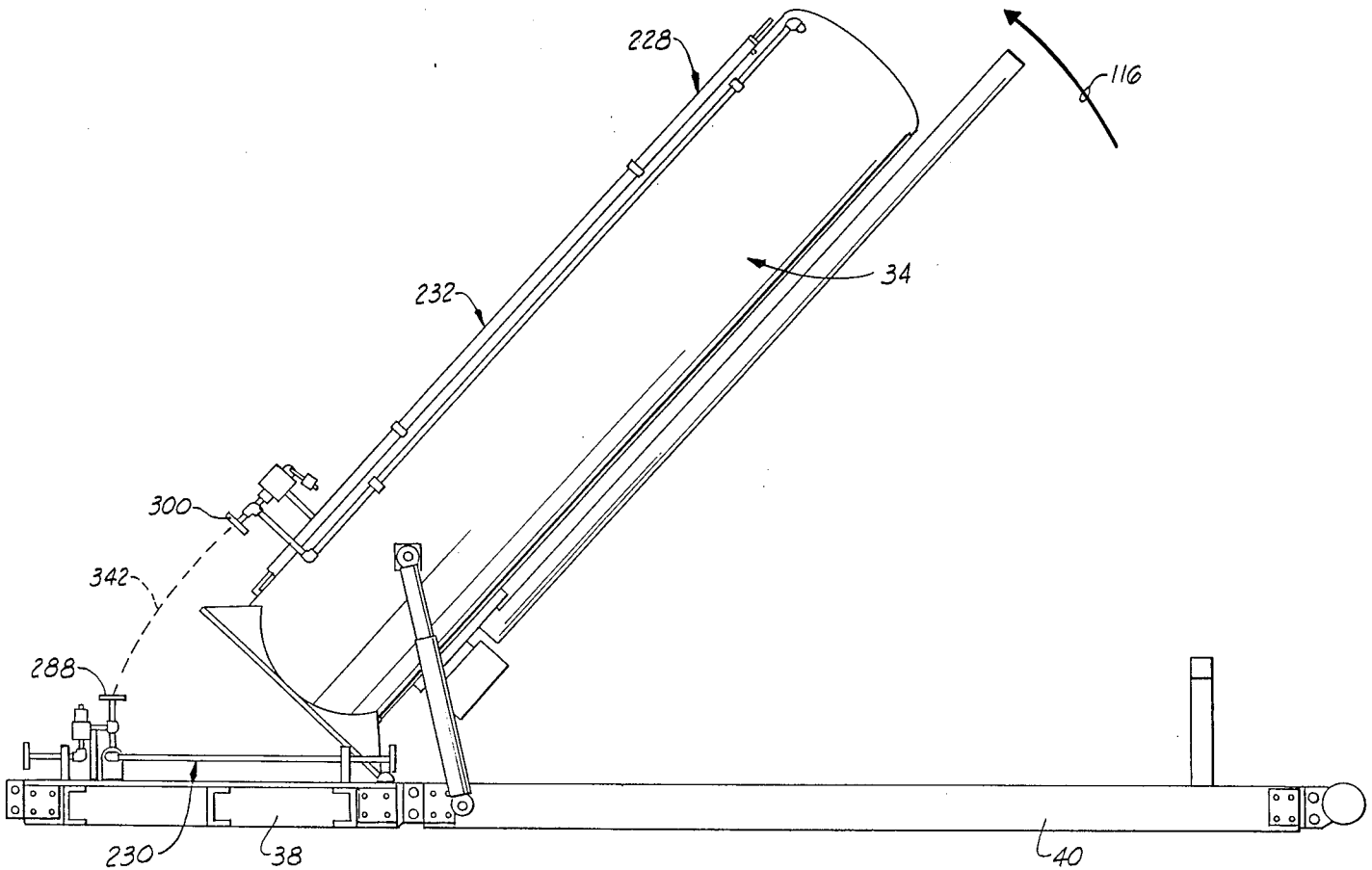

In keeping with the concept of removal of portions of the fluid processing system 30 that do not enter into fluid separation per se from the site of a well once the system 30 has been emplaced, while still providing for ease of emplacement, the system 30 further comprises a detachable loading hitch 200, specifically illustrated in FIGS. 17 and 18, that can be pinned to a male connector 152 so that a loading hitch 200 can be mounted at each end of the skid 32 by bolting male connectors on the base beams 46 and 48 of the second skid section 40, at the end 56 thereof, and the base beams 124 and 126 of the third skid section 42, at the end 130 thereof, as shown in FIGS. 4 and 10. For this purpose, and as illustrated in FIGS. 17 and 18, the loading hitch is comprised of a cylindrical tube 202 that can be extended across one end of the skid 32, as shown in FIG. 3, and has enlarged end plates 204 that provide for ease of attachment of a drag chain to the loading hitch 200. To provide for the attachment of a loading hitch 200 to a male connector 152, two plates 206 and 208 are welded to the tube 202 adjacent one end 210 of the loading hitch 200 and a similar pair of plates 212 and 214 are welded to the tube 202 adjacent the opposite end 216 of the loading hitch 200. The spacing between the plate pair 206 and 208 and the plate pair 212 and 214 is made equal to the spacing between the base beams of each skid section 38–42 and each plate for each pair has an exension (218–224 for the plates 206, 208, 212 and 214 respectively) constructed to duplicate a portion 184 or 186 of a plate 170 or 172 of a female connector 168 so that each plate pair can receive a male connector 152. As in the case of the plates 170 and 172, portions of the extensions 218–224 remote from the tube 202 are angled outwardly to facilitate insertion of a plate 164 of a male connector between the extensions 218 and 220 and the extensions 222 and 224. Each of the extensions 218–220 is provided with a pair of holes 226 that are vertically spaced to mate with the holes 166 formed through the plate 164 of a male connector 152 so that loading hitches 200 can be mounted on the ends of the assembled skid 32 via male connectors 152 bolted to the base beams 46 and 48 of the second skid section 40, at the end 56 thereof, as shown in FIG. 4, and male connectors 152 bolted to the base beams 124 and 126 of the third skid section 42, at the end 130 thereof, as shown in FIG. 10.

Returning now to FIGS. 1–3 and with additional reference to FIGS. 19 and 20, the oil well fluid processing system 30 is further comprised of a first pipe manifold 228 having a first portion 230 mounted on the first skid section 38 and a second portion 232 mounted on the heater-treater 34. Referring particularly to FIGS. 3 and 20, the first portion 230 of the pipe manifold 228 is comprised of an inlet pipe 234 mounted on the cover plate 96 to provide for the inlet of a mixture of water and oil into the heater-treater 34. The inlet pipe 234 extends from a conventional coupling flange 226 at one corner of the first skid section 38 to a vertical pipe 244 (FIG. 20) having an open upper end and upon which is mounted a coupling flange 246 via conventional pipe couplings and pipe sections 238 (FIG. 2), 240 and 242 (FIG. 3). (The pipes of the manifold portion 230 are supported by brackets which, for clarity of illustration, have not been numerically designated in the drawings.) The coupling flanges are of the conventional type having the form of perforated discs that are bolted together about a gasket to form a seal between two open ended pipes upon which the flanges are mounted.

As shown in FIG. 3, the inlet pipe 234 is further connected, via valves 248 and 250 and a pipe section 252, to an oil outlet pipe 254 that terminates in a coupling flange 256 at the corner of the first skid section 38 that is on the same side of the first skid section 38 as the coupling flange 236 but at an opposite end of the skid section 38. The oil outlet pipe is connected via the pipe 252 and a pipe 258 (FIG. 20) to a vertical pipe 260 having an open upper end upon which is mounted on an apertured coupling flange 262.

In addition to the inlet pipe and the oil outlet pipe, the first portion 230 of the first pipe manifold 222 is comprised of a water outlet pipe 264 (FIG. 3) extending along a side of the skid section 38 opposite the oil outlet pipe 254 and terminating in a coupling flange 266 in the corner of the skid section 38 at the same end of the skid section 38 as the coupling flange 256 but at the opposite side thereof. The water outlet pipe 264 is connected to an open-ended, vertical pipe 272 (FIG. 20) upon which a flange coupler 274 (FIG. 3) is mounted via a pipe 270. The pipes 258 and 270 connected to the oil and water outlet pipes respectively can be interconnected via a valve 280 and suitable piping (not numerically designated in the drawings) to provide for flexibility in the delivery of oil and water from the heater-treater 34.

At the remaining corner of the skid section 38, the first portion 230 of the first pipe manifold 228 has a vent pipe 282 that terminates in a coupling flange 284 and extends, via suitable pipes (not numerically designated in the drawings) and a back pressure regulator 286 (FIG. 20) to a vertically standing, open-ended pipe 286 to the upper end of which is connected a flange coupler 287 (FIG. 20) (FIG. 3). It will thus be seen in FIG. 3 that each of the pipes of the manifold portion 230 extends from a flange coupler at a corner of the skid section 38 to a vertical, open-ended pipe that is surmounted by a flange coupler and that the flange couplers 246, 262, 274 and 288 extend in a lateral row across the first skid section 38 near the end thereof opposite the end at which the heater-treater is pivotally connected to the cover plate 96.

With particular reference to FIG. 3, the second portion 232 of the manifold 228 is comprised of a fluid inlet pipe 290, an oil outlet pipe 292, and a gas outlet pipe 294, all of which are mounted on the wall of the heater-treater 34 via suitable brackets (not numerically designated in the drawings) and are fluidly communicated with the interior of the heater-treater 34 near the upper end 80 of the heater-treater 34. Each of the pipes 290, 292, and 294 extend along the heater-treater 34 to a position adjacent the lower end 120 of the heater-treater 34 to terminate in lower open ends upon which are mounted coupling flanges 296, 298 and 300 respectively. Suitable bends are made in the pipes 290, 292 and 294 so that, when the heater-treater 34 is moved to a vertical position on the first skid section 38, the coupling flanges 296, 298 and 300 will mate with the flanges 262, 246 and 288 respectively, as has been illustrated in FIG. 20. Thus, when the heater-treater 34 is moved to a vertical position, connection of the inlet pipe of the first portion of the pipe manifold 228 to the inlet pipe of the second portion thereof, connection of the oil outlet pipes of the two portions of the pipe manifold 228 and connection of the gas outlet pipe 294 to the vent pipe 282 can be rapidly accomplished by placing a suitable gasket on each of the flanges 246, 262 and 288 and bolting the flanges 296, 298 and 300 to the flanges 246, 262 and 288 respectively.

In addition to the fluid pipes 290–294, the second portion 232 of the first pipe manifold also comprises a water outlet pipe 302 that fluidly communicates with portions of the interior of the heater-treater 34 near the lower end 120 thereof and extends via a conventional dump valve 304 to a vertical, open-ended pipe 306 upon the lower end of which is mounted a coupling flange 308. The coupling flange 308 is laterally positioned so that, as illustrated in FIG. 20, the coupling flange 308 will abut the flange connector 274 when the heater-treater 34 is moved to the vertical position shown in FIG. 20 to permit rapid sealing of the water outlet pipe 302 of the second portion of the manifold 232 to the water outlet pipe 264 of the first portion of the manifold 228 by bolting the flange 274 to the flange 308 about a gasket (not shown).

A second pipe manifold generally designated 310 is similarly provided for the gas separator 36 on the third skid section 42. In particular, the second pipe manifold 310 is comprised of an inlet pipe 312 that terminates in a coupling flange 314 at one corner of the third skid section 42 and connects to a pipe 313 that extends upwardly along the gas separator 36 to communicate with upper portions of the interior of the gas separator 36 via a pipe 316. Near the top 318 of the gas separator 36, an open-ended pipe 320 (FIG. 3) extends through the wall of the gas separator 36 to connect via pipes 322 and 324 to a gas outlet pipe 326 (FIG. 1) near the corner of the third skid section 42 displaced laterally from the corner in which the inlet pipe for the gas separator 36 is disposed. The gas outlet pipe 326 terminates in an open end upon which is mounted a coupling flange 328. The pipe 322 is further connected to an open-ended vent pipe 330 which carries a flange connector 332 and is located at the corner of the third skid section 42 longitudinally opposite the flange connector 328. The vent pipe 330 and gas outlet pipe 326 can be connected together via suitable valves (not numerically designated in the drawings) so that gas separated from oil and water in the gas separator 36 can be channeled to the outlet pipe 326 for delivery to a sales line or to the vent pipe 330 for release to the atmosphere.

At the remaining corner of the third skid section 42, the second pipe manifold 310 is comprised of an open-ended liquid outlet pipe 334 upon which is mounted a coupling flange 336 for delivery of oil and water from the gas separator 36 via a pipe 38 and a conventional float operated dump valve 340 that is in fluid communication with lower portions of the interior of the gas separator 36.

Emplacement of the Fluid Processing System

For transport of the fluid processing system 30 to the site of a well, the fluid processing system is placed in the transport mode which has been illustrated in FIGS. 1–3. In this mode, a male or female connector is bolted to each end of each skid section base beam so that the three skid sections can be pinned together and the heater-treater 34 is positioned to overlay the second skid section 40 so that upper portions of the heater-treater are supported by the cradle 78 and lower portions are supported by the above described hinge connection to the first skid section 38. With the system 30 so disposed, and with loading hitches 200 mounted on each end of the skid 32, the system 30 can be easily loaded aboard a flatbed truck for delivery to the site of an oil well. When the site of the oil well is reached, the system 30 is off-loaded and moved by suitable handling equipment to a position at which it is desired that the gas separator 36 be located once the system has been deployed. At this point, the pins of the connectors 44 connecting the third skid section 42 to the first skid section 38 are removed from the male and female connectors to free the third skid section 42 from the first skid section 38.

The first and second skid sections 38 and 40 are then moved as a unit to the position at which the heater-treater 34 is to be located and the eyes 68 on the pistons 70 of the hydraulic actuating cylinders 62 and 64 are removed from the pins 66 on the second skid section 40 and placed on the pins 72 extending from the sides of the heater-treater 34. The hydraulic actuating cylinders are then operated from a suitable source of pressurized hydraulic fluid (not shown) to swing the heater-treater 34 in the direction 116 shown in FIG. 19 so that the flange couplings 296, 298, 300 and 308 move along the arc 342 to abut the flange couplings 246, 262, 274 and 288 respectively, of the first portion 230 of the first pipe manifold 228. Just before the two sets of flanges abut, movement of the heater-treater 34 along the arc 116 is temporarily halted so that suitable gaskets can be placed on the flanges 246, 262, 274 and 288. The movement of the heater-treater 34 to the fully vertical position is then continued to abut the flanges 246, 262, 274 and 288 respectively, so that seals can be formed between the two portions 230 and 232 of the first pipe manifold 228 by bolting the flanges 296, 298, 300 and 308 to the flanges 246, 262, 274 and 288 respectively. The eyes 68 of the hydraulic actuating cylinders 62 and 64 are then returned to the pins 66 on the sides of the second skid section 40 and the pins of the connecting assemblies 44 between the skid sections 38 and 40 are removed so that the second skid section 40 can be reloaded on the flatbed delivery truck.

As indicated in FIG. 21, the deployment of the system 30 is completed by connecting the inlet pipe 312 of the second pipe manifold 310 to the well via a pipe 344, connecting the gas outlet pipe 326 to a sales line 345, connecting the liquid outlet pipe 334 of the second pipe manifold 310 to the inlet pipe 234 of the first pipe manifold 228 via a pipe 346, connecting the vent pipes 282 and 330 of the first and second pipe manifold 228 and 310 respectively, to a common vent pipe 348 and connecting the oil and water outlet pipes 254 and 256 to a tank battery via pipes 350 and 352 respectively. The loading hitch 200 is then removed from the third skid section 42 and, with the second skid section 40 is transported away from the site of the oil well. It will be noticed that, at this time, the first and third skid sections 38 and 42 respectively, left at the site of the well, will remain in a condition to be rapidly reconnected for transport from the site of the well. That is, the male and female connectors of the connector assemblies 44 mounted on the skid sections 38 and 42 will remain in place so that, should the need arise, the skid sections 38 and 42 can be rapidly reconnected and rapidly reconnected to a second skid section 40. Thus, should the well not produce oil in quantities justifying the continued operation of the well, the system 30 can be rapidly removed from the site of the well. Should the well prove to be commercially operable, the bolt connections of the male and female connectors to the base beams of the skid sections 38 and 42 permit a subsequent visit to the site of the well for removal of male and female connectors still attached to the skid sections 38 and 42 by removing the bolts holding the connectors to the base beams of the skid sections. Such removal of the connectors leaves the skid sections 38 and 42, with the heater-treater 34 and gas separator 36 thereon, in a condition that presents no means for readily preparing the heater-treater 34 and gas separator 36 for transport to prevent theft.

It will thus be clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A portable system for processing fluids produced by an oil well, comprising:

a skid;

a cylindrical fluid processing apparatus pivotally mounted at a lower end thereof on the skid for movement between a lowered position wherein the fluid processing apparatus extends longitudinally along the skid and a raised position wherein the fluid processing apparatus extends substantially vertically from the skid;

means, mounted on the skid and connectable to the fluid processing apparatus, for moving the fluid processing apparatus between the raised and lowered positions thereof;

a pipe manifold having a first portion mounted on the skid and a second portion mounted on the fluid processing apparatus; wherein the first portion of the manifold comprises a plurality of vertical pipes having open upper ends adjacent the lower end of the fluid processor, wherein the second portion of the fluid manifold comprises a plurality of pipes having upper ends in fluid communication with the interior of the fluid processing apparatus and open lower ends adjacent the lower end of the fluid processing apparatus, and wherein the first and second portions of the fluid manifold are positioned on the skid and fluid processing apparatus to abut the open end of each pipe of the first portion of the fluid manifold with the open end of a pipe of the second portion of the fluid manifold in the raised position of the fluid processing apparatus; and coupling means on the pipes of the first and second portions of the fluid manifold for sealing abutting ends of the pipes of the first portion of the fluid manifold with pipes of the second portion of the fluid manifold.

2. The system of claim 1 wherein the skid comprises:

a first skid section whereon the fluid processing apparatus and the pipe manifold are mounted;

a second skid section whereon the means for moving the fluid processing apparatus is mounted; and means for pinning one end of the first skid section to one end of the second skid section.

3. The system of claim 2 wherein the fluid processing apparatus is mounted on the first skid section adjacent the end of the first skid section that can be pinned to the second skid section and wherein the lowered position of the fluid processing apparatus is further characterized as a position wherein the fluid processing apparatus overlays the second skid section at such times that the second skid section is pinned to the first skid section.

4. The system of claim 3 wherein the fluid processing apparatus is characterized as being an apparatus for separating a water-oil mixture into separate liquid components for storage; wherein the skid further comprises:

a third skid section; and means for pinning one end of the third skid section to the end of the first skid section opposite the end of the first skid section coupled to the second skid section; and wherein the system further comprises:

a gas-liquid separation apparatus mounted on the third skid section for separating a gas-liquid mixture into gas and liquid components; and a second pipe manifold mounted on the third skid section and gas-liquid separation apparatus, the second pipe manifold fluidly communicating with the interior of the gas-liquid separation apparatus and comprising:

an inlet pipe for receiving fluid from the oil well;

a gas outlet pipe for delivery of natural gas from the gas-liquid separation apparatus; and a liquid outlet pipe for delivery of a mixture of oil and water from the gas-liquid separation apparatus; and wherein the first portion of the pipe manifold mounted on the first skid section comprises:

an inlet pipe for receiving a mixture of oil and water;

a water outlet pipe; and an oil outlet pipe, whereby the system can be placed in a condition to process fluids produced by an oil well by connecting the inlet pipe of the second pipe manifold to the oil well, moving the apparatus for separating a water-oil mixture into separate liquid components to the raised position thereof on the first skid section, coupling the pipes of the first and second portions of the fluid manifold on the first skid section together, and connecting the liquid outlet pipe of the second pipe manifold to the inlet pipe of the pipe manifold on the first skid section.

5. The system of claim 1 wherein the fluid processing apparatus is characterized as being an apparatus for separating a water-oil mixture into separate liquid components for storage; and wherein the system further comprises a gas-liquid separation apparatus mounted on the skid.

6. The system of claim 1 wherein the coupling means on the pipes of the first and second portions of the fluid manifold comprises a flange mounted on the upper end of each vertical pipe of the first portion of the manifold and a flange mounted on the lower end of each pipe of the second portion of the pipe manifold, the flanges having a plurality of holes formed therethrough for bolting flanges on pipes of the first portion of the pipe manifold to flanges on pipes of the second portion of the pipe manifold.

7. An oil well fluid processing system, comprising:

a skid having a first skid section and a second skid section separable from the first skid section;

means for connecting one end of the first skid section to one end of the second skid section;

a cylindrical fluid processing apparatus pivotally mounted at a lower end thereof on the first skid section for pivoting movement between a raised position wherein the fluid processing apparatus extends vertically from the first skid section and a lowered position wherein the fluid processing apparatus overlays the second skid section at such times that the two sections of the skid are connected together; and means mounted on the second skid section and connectable to the fluid processing apparatus for moving the fluid processing apparatus between the raised and lowered positions at such times that the two sections of the skid are connected together.

8. The apparatus of claim 7 wherein the skid further comprises a third skid section separable from the first and second skid sections and wherein the system further comprises:

a second fluid processing apparatus mounted on the third skid section; and means for connecting one end of the third skid section to the other end of the first skid section.

9. The apparatus of claim 8 wherein each of the skid sections comprises a pair of spaced apart base beams extending between the ends of the skid section and wherein each of the means for connecting one section of the skid to another section of the skid comprises a pair of skid connectors, each skid connector connecting one base beam of one skid section to one base beam of the other skid section and one skid connector connecting the other base beam of one skid section to the other base beam of the other skid section, each skid connector comprising:

a male connector attached to a base beam of one skid section and having a vertical plate extending from the end of the skid section, the vertical plate having two vertically spaced apertures formed therethrough;

a female connector attached to a base beam of the other skid section and having two spaced apart vertical plates extending from the end of the skid section to receive a plate of a male connector, the plates of the female connector having two vertically spaced apertures formed therethrough to align with the apertures of the plate of a male connector; and two pins insertable through the apertures of the plates of the male and female connectors for securing the plate of the male connector between the plates of the female connector.

10. The apparatus of claim 9 wherein the male and female connectors are bolted to the base beams cf the skid sections.

11. The apparatus of claim 7 wherein each of the skid sections comprises a pair of spaced apart base beams extending between the ends of the skid section and wherein the means for connecting the first skid section to the second skid section comprises a pair of skid connectors, one skid connector connecting one base beam of one skid section to one base beam of the other skid section and the other skid connector connecting the other base beam of one skid section to the other base beam of the other skid section, each skid connector comprising:

a male connector attached to a base beam of one skid section and having a vertical plate extending from the end of the skid section, the vertical plate having two vertically spaced apertures formed therethrough;

a female connector attached to a base beam of the other skid section and having two spaced apart vertical plates extending from the end of the skid section to receive a plate of a male connector, the plates of the female connector having two vertically spaced apertures formed therethrough to align with the apertures of the plate of a male connector; and two pins insertable through the apertures of the plates of the male and female connectors for securing the plate of the male connector between the plates of the female connector.

12. The apparatus of claim 11 wherein the male and female connectors are bolted to the base beams of the skid sections.

13. The system of claim 7 further comprising:

a loading hitch comprised of a cylindrical tube extendable along one end of the skid; and means for pinning the loading hitch to one end of the skid.

14. The system of claim 13 wherein each skid section comprises a pair of longitudinally extending base beams and wherein the means for pinning the loading hitch to one end of the skid comprises:

two male connectors, each male connector connected to a base beam of one of the skid sections and having a plate extending from the end of the skid section, the plate having two vertically positioned holes formed therethrough; and two pairs of plates welded to the tube of the loading hitch to extend about the plates of the male connectors, the plates welded to the tube of the loading hitch having two vertically spaced holes formed therethrough to align with the holes formed through the plate of the male connector; and pins insertable through the holes formed through the plates of the male connector and the plates welded to the tube of the loading hitch for securing the plates of the male connectors to the plates welded to the loading hitch.

15. The system of claim 14 wherein the male connectors are bolted to the base beams of a skid section.

* * * * *